US005288198A

United States Patent [19]

Mozingo

[11] Patent Number: 5,288,198

[45] Date of Patent: Feb. 22, 1994

[54] CONTROL MECHANISM FOR AN OFF-HIGHWAY IMPLEMENT

[75] Inventor: Robert E. Mozingo, Burlington, Iowa

[73] Assignee: Case Corporation, Racine, Wis.

[21] Appl. No.: 921,527

[22] Filed: Jul. 29, 1992

[51] Int. Cl.[5] ..... E02F 3/28

[52] U.S. Cl. ..... 414/685; 414/4; 137/636.3; 74/471 XY

[58] Field of Search ..... 414/685, 694, 4; 74/471 XY; 137/636.3, 636.2

[56] References Cited

U.S. PATENT DOCUMENTS 3,741,031 6/1973 Schwerdtfeger .
3,831,633 8/1974 Comer .
3,854,380 12/1974 Casey .
3,897,805 8/1975 Casey .
3,943,791 3/1976 Casey .
4,019,401 4/1977 Drone .
4,028,958 6/1977 Schuermann et al. .
4,187,737 2/1980 Mori et al. .
4,523,488 6/1985 Ahrendt .
4,736,647 4/1988 Shimoie et al. .
4,938,091 7/1990 Waggoner et al. .
4,978,273 12/1990 Radke et al. .
5,142,931 9/1992 Menahem ..... 74/471 XY

*Primary Examiner*—Michael S. Huppert
*Assistant Examiner*—Donald W. Underwood
*Attorney, Agent, or Firm*—Rudnick & Wolfe

[57] ABSTRACT

A control mechanism for independently or conjointly controlling three different functions of an off-highway implement. The control mechanism includes a single, vertical elongated control lever mounted for manipulation in first and second directions about first and second axes and for manipulation through a twisting action about a vertical axis extending substantially perpendicular to the first and second axes. A salient feature of the present invention is that manipulation of the control lever in the first and second directions, conjointly or independently, controls first and second functions of the implement while twisting manipulation of the control lever about its vertical axis controls a third implement function independently or conjointly relative to the other two implement functions.

8 Claims, 3 Drawing Sheets

CONTROL MECHANISM FOR AN OFF-HIGHWAY IMPLEMENT

FIELD OF THE INVENTION

The present invention generally relates to off-highway implements such as front-end loaders and the like and, more particularly, to a control mechanism for controlling operation of three separate hydraulic control valves through manipulation of a single control lever.

BACKGROUND OF THE INVENTION

Off-highway implements, such as front-end loaders and the like are typically provided with a loader mechanism at one end thereof. A conventional loader mechanism includes a working tool such as a bucket or the like pivotally connected to a frame of the implement by longitudinally extending loader arms. A series of hydraulic actuators, usually in the form of double-acting hydraulic cylinders, are connected to a hydraulic system of the implement for effecting various loader functions. Hydraulic actuators are used to elevate the bucket or tool by raising and lowering the loader arms. Hydraulic actuators are likewise used to control the roll or pivotal movement of the bucket relative to the loader arms. Many loader mechanisms further incorporate a device such as a clam shell bucket which requires a third actuator to effect articulated movement of the clam shell bucket.

Control over the various loader functions or work operations is conventionally achieved through manipulation of various control levers. Each control lever is connected to one or more control valves which, in turn, regulates hydraulic fluid flow between a pressurized hydraulic source on the implement and each of the actuators.

During operation of the implement, the loader mechanism can perform a single function but usually at least two loader functions are affected simultaneously. That is, while the loader arms are being elevationally positioned, the pivotal position or roll of the bucket may likewise be adjusted When equipped with a clam shell bucket, all three loader functions may be affected simultaneously to economize on operational time for the loader. As will be appreciated, controlling the implement's direction and speed simultaneously with the raising, lowering, tilting, and articulating the bucket of the loader mechanism through movement of at least two control levers can become a cumbersome task for anyone to perform successfully.

Thus, there is a need and a desire for a control mechanism including a single control lever capable of affecting control of various loader functions either independently of one another or in unison with one another or, in any combination desired by the operator.

SUMMARY OF THE INVENTION

In view of the above, and in accordance with the present invention, there is provided a control mechanism for independently or conjointly controlling three different functions of an off-highway implement. The control mechanism includes a single, vertically elongated control lever mounted for manipulation in first and second directions and for manipulation through a twisting action about a generally vertical axis extending substantially perpendicular to the first and second directions. A first bracket assembly mounts the control lever for movement in a first direction about a a first pivot axis and includes first actuator arranged offset from the first pivot axis such that a first implement function is affected in response to movement of the control lever in the first direction. A second bracket assembly is pivotally connected to the first bracket assembly for movement in a second direction about a second pivot axis extending transverse to the first pivot axis. The second bracket assembly includes a second actuator offset from the second pivot axis and in alignment with the first pivot axis such that a second implement function is affected in response to movement of the control over in the second direction. A lower end of the control lever is secured to the second bracket assembly for twisting movement in either direction about a vertical axis.

The control mechanism of the present invention further includes a third assembly including a third actuator aligned with the first pivot axis of the first bracket assembly and responsive to a twisting action of the control lever to effect the third implement function. A salient feature of the present invention is that manipulation of the control lever in the first and second directions, conjointly or independently, controls the first and second implement functions while twisting manipulation of the control lever controls the third implement function independently or conjointly with the other two implement functions.

In a preferred form of the invention, the first bracket assembly includes a yoke having a pair of spaced parallel arm portions on opposite sides of the first pivot axis and extending from a mounting portion. The first actuator of the first bracket assembly preferably includes a first ball joint connected to one of the arm portions of the yoke in offset relation to the first pivot axis.

The second bracket assembly of the control mechanism includes a mounting member having an inverted U-shaped cross-section with a pair of parallel arm portions joined to each other by a bridge portion. The parallel arm portions of the mounting member are joined to the yoke of the first bracket assembly by a pair of axially aligned pins defining the second pivot axis. The second actuator of the second bracket assembly preferably includes a second ball joint carried by one of the arm portions of the mounting member in offset relation to the second pivot axis of the second bracket assembly.

The control lever is connected to and extends upwardly from the second bracket assembly. A lower end of the control lever is mounted to the bridge portion of the second bracket assembly for twisting movements about a vertical pivot axis extending substantially perpendicular to the first and second pivot axes.

The control mechanism of the present invention is particularly useful for independently or conjointly controlling three different functions of a front-end loader including a loader mechanism supported from a wheeled frame of the loader for generally vertical movement. The loader mechanism includes a pair of loader arms pivotally attached to the frame for movement about a horizontal axis, a loader bucket pivotally attached to the distal ends of the loaders arms and wherein the loader bucket is in the form of a clam shell bucket which is articulated for movement about a transversely extending axis between open and closed positions. The front-end loader further includes a hydraulic system including first, second and third hydraulic actuators for effecting the various loader functions including elevating the bucket relative to the frame, pivoting the bucket relative to the loader arms, and the articulating movements of the bucket to effect a "grab" function.

The control mechanism of the present invention is interposed between a hydraulic power source and the actuators for selectively controlling the loader functions. The elongated control lever of the control mechanism is readily accessible to the operator of the front-end loader and is connected to the frame in a manner allowing for manipulation of the lever in four different directions each extending away from a neutral position to operatively control the elevational and pivotal functions of the loader mechanism and also for manipulating the control lever through a twisting action about a generally vertical axis for vertically controlling the articulated function of the bucket.

The first actuator on the first bracket assembly is responsive to the fore-and-aft movements of the control lever relative to the neutral position for effecting operation of one of the hydraulic actuators in response to such movement to control one function of the loader mechanism. Movement of the second bracket assembly about the second axis induces movement of the second actuator for effecting operation of another hydraulic actuator to control another loader mechanism function. The control lever is rotationally affixed to the second bracket assembly to allow for twisting movement of the control lever in opposite directions about the vertical axis.

The third bracket assembly is preferably carried by the first bracket assembly and the third actuator carried thereby is responsive to twisting manipulation of the control lever to regulate operation of the third hydraulic actuator to control the third loader mechanism function. The third actuator is disposed in relation to the first and second axes of the mounting means such that the movements of the control lever can independently or conjointly effect the various loader functions relative to each other as by one-handed control.

In a most preferred form of the invention, the third actuator of the third bracket assembly preferably includes a cam and follower assembly. The cam is connected to the control lever and has the follower responding to movements of the cam to control the third loader function as a result of such movements. Preferably, the cam includes a slotted plate affixed to the control lever and with the follower including a roller adapted for movements between opposite ends of the slot and carried by a lever mounted for oscillatory movements on the first bracket.

With the present invention, three different operative functions of a front-end loader are controlled through a single control lever. Each operative function of the loader mechanism can be effected independently or conjointly relative to each other. With the present invention, the cumbersome task of having to manipulate two separate controls to operate a loader mechanism having an operative auxiliary device has been eliminated. Another advantage of the present invention is the provision of a three function control mechanism which is durable in construction, inexpensive to manufacture, carefree regarding maintenance, as well as being simple and effective in use.

These and numerous other features and advantages of the present invention will become readily apparent from the following detailed description, the accompanying drawings, and the appended claims.

DETAILED DESCRIPTION OF THE INVENTION

Figure 1:
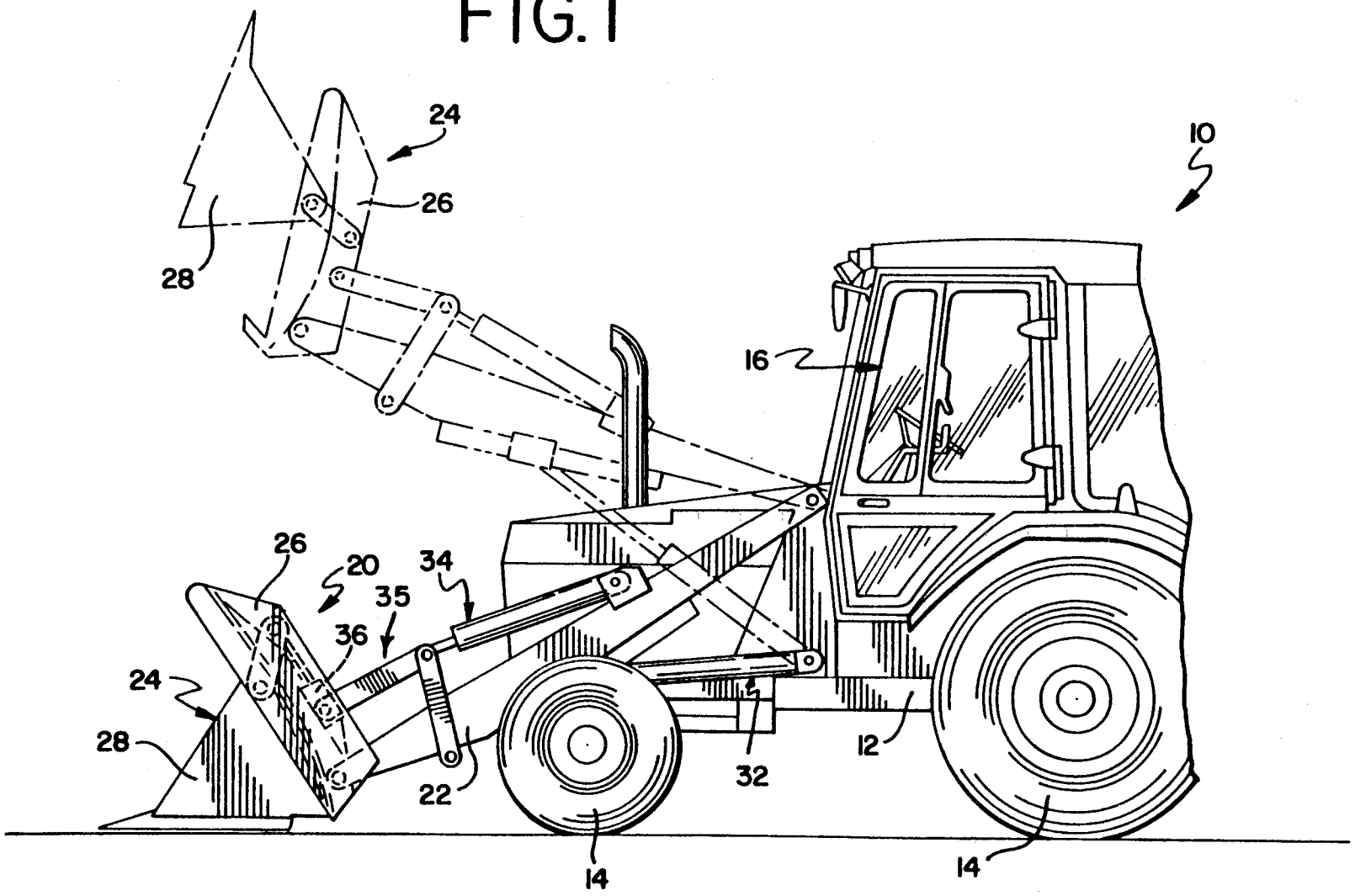
FIG. 1 is a side elevational view of an off-highway implement in the form of a front end loader incorporating principles of the present invention.

While the present invention is susceptible of embodiment in various forms, there is shown in the drawings a preferred embodiment of the invention which is hereinafter described, with the understanding that the present disclosure is to be considered as an exemplification of the invention, and is not intended to limit the invention to specific embodiment illustrated.

Referring now to the drawings, wherein like reference numerals indicate like parts throughout the several views, FIG. 1 schematically shows an off-highway implement such as a front-end loader designated generally by reference numeral 10. Loader 10 includes a frame 12 provided with wheels 14 to permit mobile movement of the loader over the ground. Loader 10 further includes an operator station 16 in which various operative controls are conveniently accessible to permit the operator to control various loader functions. Although the control mechanism of the present invention is described as being arranged on a front-end loader, the invention should not be so limited as it may be equally applied to other off-highway implements which would be facilitated by single lever three function control.

Loader 10 also includes a loader mechanism 20 supported from the frame for handling of materials. As is conventional, loader mechanism 20 includes a pair of fore-and-aft extending loader arms 22 pivotally connected to the frame 12 for elevational movements about a generally horizontal axis. A working tool 24, such as a bucket, is pivotally connected between the distal ends of the arms 22 for pivotal or rolling movements. In the illustrated embodiment, bucket 24 is capable of independent articulated movement such as shown in phantom lines in FIG. 1. Such a bucket typically includes a base member 26 connected to the loader arms 22 and a clam member 28 pivotally supported from base member 26 and movable relative thereto between open and closed positions to effect a "grab" function for the loader mechanism.

Loader 10 is provided with a hydraulic system including a hydraulic fluid source (not shown) for providing pressurized hydraulic fluid to various hydraulic actuating components of loader 10. The hydraulic system includes a pair of hydraulic actuators 32 interconnected between frame 12 and loader arms 22 to elevationally position the bucket 24 relative to the frame 12. Similarly, a pair of hydraulic actuators 34 interconnect loader arms 22 through a linkage 35 to the bucket 24 to effect pivotal or rolling movement of the bucket relative to the loader arms. The hydraulic system also includes a pair of hydraulic actuators 36 interconnecting the base member 26 of bucket 24 to the movable member 28 to effect articulated movement of member 28 relative to member 26 between open and closed positions. Each of the hydraulic actuators 32, 34, and 36 are preferably in the form of linearly extendable/retractable hydraulic cylinders which are provided with conventional plumbing connections to provide hydraulic fluid under pressure thus affecting various loader functions as controlled by the operator.

A control mechanism 40 is provided between the power source and the actuators 32, 34 and 36 for selectively controlling the loader functions. In the embodiment illustrated in FIG. 2, control mechanism 40 is used to operate a valve assembly 41 mounted on the frame of the loader and including valves 42, 44, and 46. As is conventional, each valve 42, 44 and 46 includes a valve stem 48 which positions a spool valve (not shown) thereby regulating fluid through the respective valve. As shown, valve 42 controls operation of the lift actuators 32; valve 44 controls operation of the tilt actuators 34; while, valve 46 controls operation of the clam-shell actuators 36.

The control mechanism 40 for operating the valve assembly 41 and thereby the loader mechanism 20 includes a control lever 50 which is carried on a mounting assembly 52. An upper end of control lever 50 is positioned within the operator compartment 16 (FIG. 1) for convenient access by the operator. The lower end of control lever 50 is connected to the mounting assembly 52 to allow for manipulation of the control lever in first and second directions extending normal to each other and also allows for manipulation of the control lever 50 through a twisting action about a generally vertical axis 54 which extends substantially perpendicular to the first and second directions.

In the illustrated embodiment, the mounting assembly 52 includes first and second interconnected bracket assemblies 56 and 58, respectively. The first bracket assembly 56 mounts the control mechanism 40 to the loader frame 12 and is movable in opposite rotational directions about a first pivot axis 60. The first bracket assembly 56 includes a first actuator 62 which is responsive to movements of the bracket assembly 56 about axis 60 and is operatively effective to control one function of the loader mechanism.

The second bracket assembly 58 is pivotally connected to the first bracket assembly 56 and is movable in opposite rotational directions about a second pivot axis 64. The second bracket assembly 58 includes a second actuator 66 which is responsive to movements of bracket assembly 58 in opposite rotational directions about the pivot axis 64 and is operatively effective to control a second function of the loader mechanism.

Figure 3:
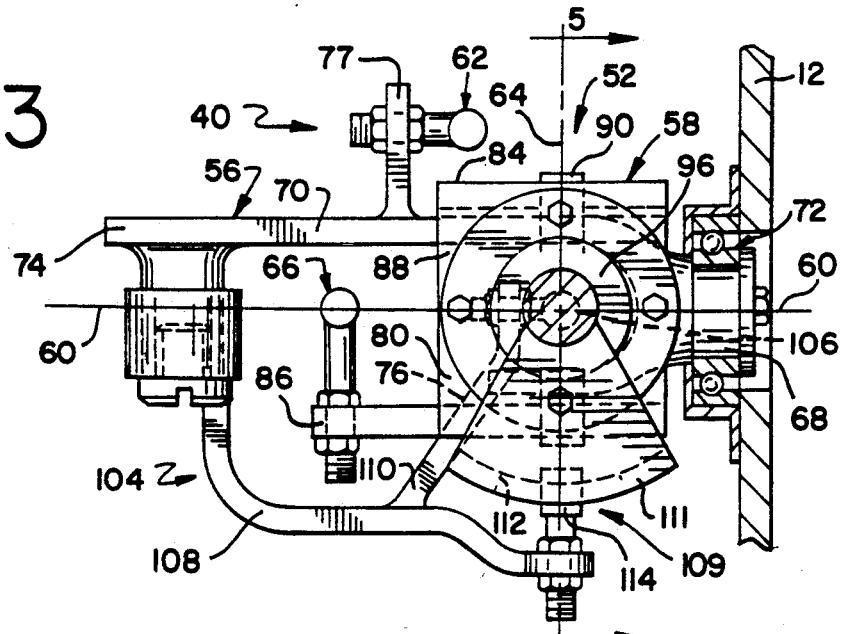
FIG. 3 is a top plan view, partially in section, of the control mechanism of the present invention.
Figure 5:
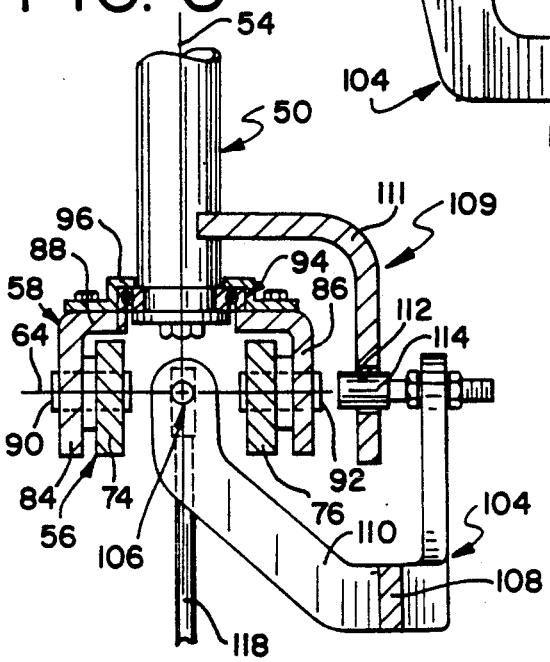
FIG. 5 is a sectional view taken along line 5—5 of the FIG. 3.
Figure 6:
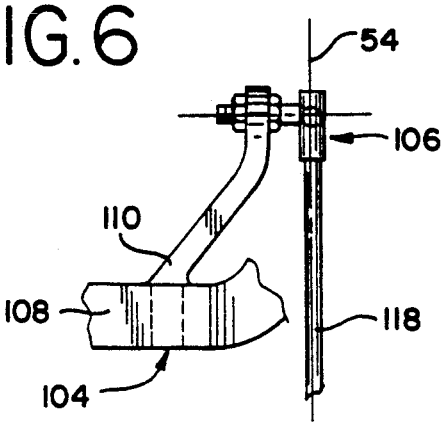
FIG. 6 is a partial side elevational view of a portion of the control mechanism of the present invention.

Turning to FIGS. 3 and 5, bracket assembly 56 is preferably configured with a mounting portion 68 and a yoke portion 70. As shown, mounting portion 68 of bracket assembly 56 is journalled within a bearing assembly 72 carried by the loader frame 12 and allows for rotation of the bracket assembly 56 about axis 60 while inhibiting endwise movement of the bracket assembly 56 along axis 60. Yoke portion 70 of bracket assembly 56 includes a pair of generally parallel extending and spaced leg portions 74 and 76 extending from and connected to the mounting portion 68. As shown, leg portions 74 and 76 are arranged on opposite sides of axis 60. In the illustrated embodiment, an extension 77 projects outwardly from the leg portion 74 for mounting actuator 62 in radially spaced relation to axis 60.

Figure 2:
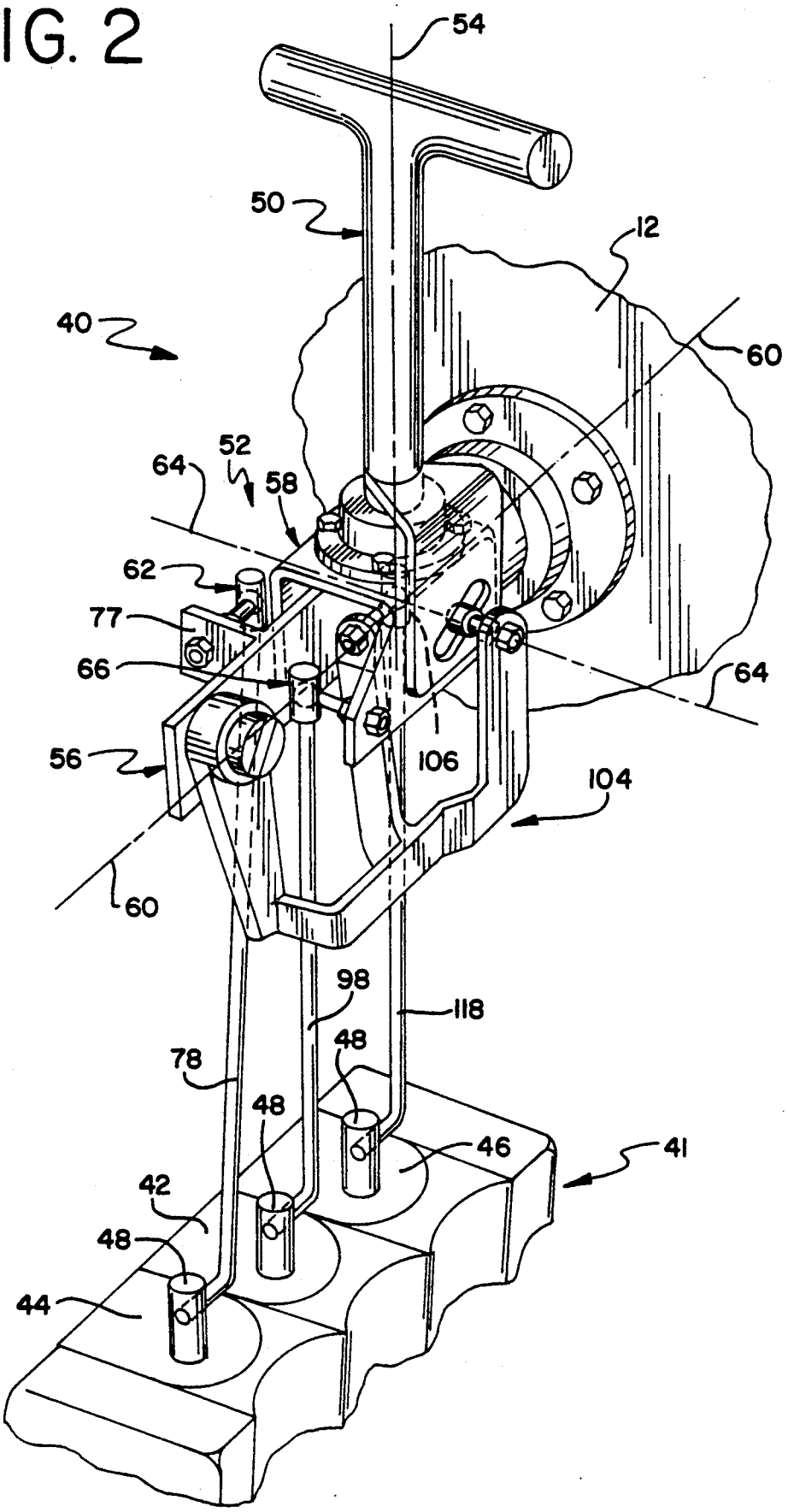
FIG. 2 is a perspective view of a control mechanism according to the present invention.

As shown, actuator 62 preferably includes a spherical coupling or ball joint to substantially eliminate binding forces which inhibit the transfer of motion upon rotation of bracket assembly 56. As shown in FIG. 2, the ball joint actuator 62 is connected to the stem portion 48 of valve 44 through suitable linkage means 78 such that rotation of bracket assembly 56 to either side of a neutral position and about pivot axis 60 results in displacement of the valve spool of valve 44 to effect operation of hydraulic actuator 34 and thereby the pivotal movement or roll of the bucket 24 relative to the loader arms 22.

The second bracket assembly 58 includes a mounting member 80 having an inverted U-shaped cross-sectional configuration including a pair of parallel arm portions 84, 86 joined to each other at their upper ends by a bridge portion 88. The arm portions 84, 86 of bracket assembly 58 straddle and are pivotally attached to leg portions 74, 76, respectively, of bracket assembly 56. A pair of axially aligned pins 90 and 92 pivotally interconnect bracket assemblies 56 and 58 to each other and define the second pivot axis 64 of the mounting assembly 52.

Actuator 66 is preferably carried by arm portion 86 in radially spaced relation to the second pivot axis 64 of the second bracket assembly. Notably, actuator 66 extends from the arm portion 86 and is centered or aligned with the first pivot axis 60 of the mounting assembly.

As shown, actuator 66 preferably includes a spherical coupling or ball joint to substantially eliminate binding forces which inhibit transfer of motion upon rotation of bracket assembly 58. As shown in FIG. 1, the ball joint actuator 66 is connected to the stem portion 48 of valve 42 through suitable linkage means 98 such that rotation of bracket assembly 58 to either side of a neutral position and about pivot axis 64 results in displacement of the valve spool of valve 42 to effect operation of actuator 32 and thereby the elevation of the bucket 24 relative to the frame 12.

As shown in FIG. 5, a lower end of control lever 50 is connected to and carried by bracket assembly 58. In the illustrated embodiment, the lower end of the control lever 50 is journalled in a bearing assembly 94 for twisting movements about axis 54 an extension reference line of which intersects with and extends substantially perpendicular to pivot axes 60 and 64. Bearing assembly 94 is affixed to the bridge portion 88 of bracket assembly 58 as by a cap 96.

The control mechanism 40 of the present invention further includes a third bracket assembly 104 for effecting the third implement function in response to twisting movements of the control lever 50 in opposite directions away from a neutral position and about axis 54. As shown, the third bracket assembly 104 includes a third actuator 106. When the control lever 50 is in a neutral position, the third actuator 106 is disposed in alignment with the pivot axis 54, 60 and 64 of the mounting assembly 52 such that the operative functions of the loader mechanism controlled through movements of the control lever 50 can be effected independently or conjointly relative to each other with one-handed control.

Figure 4:
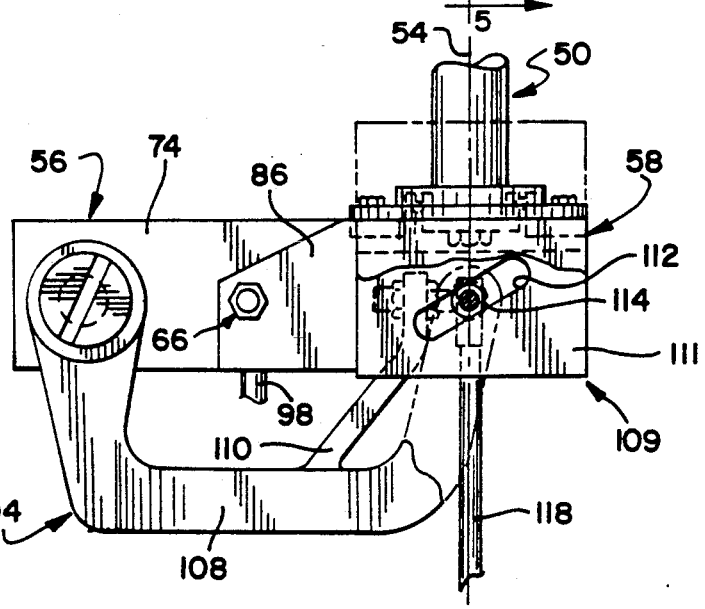
FIG. 4 is a right side elevational view of the control mechanism.

In the illustrated embodiment, the third actuator 106 of the third bracket assembly 104 is carried by a lever 108 having one end pivotally mounted on leg portion 74 of bracket assembly 56 to allow for oscillatory movement of the lever 108. Oscillatory movements of lever 108 are controlled by a cam and follower mechanism generally designated by reference numeral 109 and including a radially extending member 111 having a curved profile generally concentric about axis 54. Member 111 is operatively connected to the control lever 50 such that rotation of lever 50 will likewise cause radial displacement of member 111. As shown in FIGS. 3 and 4, member 111 has a cam-like configuration defined by an elongated slot 112 having a vertical component. The free end of lever 108 is provided with a cam follower 114 which cooperates with and is captively received between opposite ends of slot 112.

Intermediate its opposite ends, lever 108 is provided with an offset leg portion 110 to which actuator 106 is secured for movement in response oscillatory movements of lever 108. As shown in FIG. 5, the free end of the offset leg portion 110 extends between the bifurcated legs 74 and 76 of bracket assembly 56 to position actuator 106 of the third bracket assembly 104 in alignment with pivot axes 60 and 64 of the mounting assembly 52.

As shown, actuator 106 preferably includes a spherical coupling or ball joint to substantially eliminate binding forces from inhibiting transfer of motion upon twisting rotation of the control lever about axis 54. As shown in FIG. 2, the ball joint actuator 106 is connected to the stem portion of valve 48 through suitable linkage means 118 such that twisting action of control lever 50 to either side of a neutral position and about axis 54 results in displacement of the valve spool of valve 46 and thus effects operation of actuator 36.

During operation, the operator can manipulate the control lever 50 in several different directions to independently or conjointly control the three functions of the loader mechanism 20. The control lever 50 may be moved in a fore-and-aft direction which induces pivotal movement to bracket assembly 58 about axis 64 to effect operation of the loader lift actuators 32 for raising and lowering the loader mechanism 20. As will be appreciated, fore-and-aft movements of the control lever 50 causes displacement of actuator 66 and thereby causes linkage 98 to position valve 48 thereby controlling the direction of flow of hydraulic fluid under pressure to the actuating cylinders 32 to effect raising and lowering of the loader arms 22.

Similarly, transverse or side-to-side movement of the control lever 50 induces pivotal rotation of bracket 56 about axis 60. As will be appreciated, side-to-side control lever 50 effects generally vertical displacement of the ball joint actuator 62 Such movement of actuator 62 results in movement of linkage 78 and corresponding linear displacement of the stem 48 of valve 34 thus controlling the direction of flow of hydraulic fluid under pressure to the bucket tilt cylinders 34 to manipulate the pivotal movement of the bucket 24 relative to the loader arms 22.

Articulated movement of the clam member 28 relative to the base member 26 of bucket is affected through a twisting action of the control lever 50 about axis 54. The twisting action of control lever 50 is translated through the third bracket assembly 104 into vertical movements of the ball joint actuator 106. Vertical movement of the actuator 106 results in movement of linkage 118 and corresponding linear movement of the stem 48 of valve 46 thus controlling the direction of flow of hydraulic fluid under pressure to the cylinder actuators 36 to effect pivotal movement of member 28 relative to base member 26.

The mounting assembly 52 allows the control lever 50 to be manipulated in four different directions each extending away from a neutral position so as to operatively control the elevation and pivotal functions of the loader mechanism and furthermore allows the control lever 50 to be twisted about axis 54 to control the articulated function of the bucket. With the control lever 50 in a neutral position, as shown in the drawings, the ball joint actuator 66 is aligned with the pivot axis 60 of the mounting assembly 40. Accordingly, transverse or side-to-side movement of the control lever 50 will not influence operation of the actuators used to effect raising and lowering of the working tool or articulated movement of the working tool. Similarly, when control lever 50 is in a neutral position, the ball joint actuator 106 is aligned with the pivot axis 60 and 64 of the mounting assembly 40. Accordingly, a twisting action of the control lever 50 about axis 54 will not affect operation of either the lift cylinders or the tilt cylinders of the loader mechanism. Accordingly, all three functions of the loader mechanism, i.e., lift, tilt, and grab can be accomplished through appropriate manipulation of the single control lever 50 conveniently accessible to the operator. Moreover, the control lever 50 can be manipulated to effect simultaneous operations of all three, or any combination thereof, so as to facilitate operation of the loader mechanism through one-handed control.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A control mechanism for independently or conjointly controlling three different functions of an off-highway implement, said control mechanism comprising:

a vertically elongated control lever; and a mounting for permitting the control lever to be manipulated in first and second directions extending generally normal relative to each other and also for permitting the control lever to be manipulated through a twisting action about a generally vertical axis extending substantially perpendicular relative to the first and second directions, said mounting including a first bracket assembly mounted for movement about a first fixed pivot axis and including a first actuator arranged in offset relation from the first pivot axis of the first bracket assembly such that a first implement function is effected in response to movement of the control lever in the first direction, a second bracket assembly having a lower end of said control lever secured thereto for twisting movements in either rotational direction about said vertical axis, said second bracket assembly being pivotally connected to said first bracket assembly for movement about a second pivot axis extending transverse relative to and which intersects the first pivot axis, said second bracket assembly including a second actuator arranged in offset relation to the second pivot axis and in alignment with said first pivot axis such that a second implement function is effected in response to movement of the control lever in the second direction, and a third bracket assembly pivotally carried by said first bracket assembly and including a third actuator which is normally located at the intersection of the first and second pivot axes of the first and second bracket assemblies, respectively, with said third actuator being movable in offset relation relative to the intersection of said first and second pivot axes to effect a third implement function in response to twisting manipulation of the control lever about said vertical axis, and whereby manipulation of the control lever in the first and second directions conjointly or independently controls the first and second implement functions while twisting manipulation of the control lever controls the third implement function either independently or conjointly with the other two implement functions.

2. The control mechanism according to claim 1 wherein said first bracket assembly includes a yoke having a pair of spaced parallel arm portions on opposite sides of the first pivot axis and extending from a mounting portion.

3. The control mechanism according to claim 2 wherein said first actuator of said first bracket assembly includes a first ball joint connected to one of said arm portions in offset relation to the first pivot axis.

4. The control mechanism according to claim 2 wherein said second bracket assembly includes a mounting member having an inverted U-shaped cross section with a pair of parallel arm portions joined to each other by a bridge portion, the parallel arm portions of said mounting member being joined to the yoke of the first bracket assembly by a pair of axially aligned pins defining said second pivot axis.

5. The control mechanism according to claim 4 wherein said second actuator of said second bracket assembly includes a second ball joint carried by one of the arm positions of the mounting in offset relation to the second pivot axis of the second bracket assembly.

6. A control mechanism for independently or conjointly controlling three functions of a front end loader having a wheeled frame, a loader mechanism supported from the frame for generally vertical movements relative thereto, said loader mechanism including a pair of loader arms pivotally attached to the frame for movement about a generally horizontal axis, a loader bucket pivotally attached to the distal end of the loader arms, said loader bucket being articulated for movement about a transversely extending axis between open and closed positions, said front end loader further including a hydraulic system including first, second and third hydraulic actuators for effecting the various functions including elevating the bucket relative to the frame, pivoting the bucket relative to the loader arms, and the articulating bucket movements, said control mechanism being interposed between a hydraulic power source and the actuators for selectively controlling the loader functions, said control mechanism comprising:

a single vertically elongated control lever; and a mount for mounting the control lever to the frame while allowing for manipulation of the control lever in four different directions each extending away from a neutral position so as to operably control the elevational and pivotal functions of the loader and also for manipulating the control lever through a twisting action about a generally vertical axis for operably controlling the articulated function of the bucket, said mount including a first bracket assembly mounted for movement about a first pivot axis fixed to the frame and provided with a first actuator which is responsive to side-to-side movements of the control lever relative to the neutral position and which effects operation of one of the hydraulic actuators in response to such movements to control one loader function, a second bracket assembly carried by the first bracket assembly for movement about a second pivot axis which intersects the first pivot axis and is provided with a second actuator which is responsive to fore-and-aft movements of the control lever relative to the neutral position and which effects operation of another hydraulic actuator to control another loader function, a bearing carried by said second bracket to mount said control lever thereon while allowing for twisting movements of said control lever in opposite directions about said vertical axis, and a third bracket assembly carried by said first bracket assembly and including a third actuator which is normally centered at the intersection of said first and second pivot axes for regulating operation of the third hydraulic actuator in response to twisting manipulation of said control lever in either direction about said vertical axis to control the third loader function, such that the loader functions controlled through movements of said control lever can be effected independently or conjointly relative to each other as by one-handed control.

7. The control mechanism according to claim 6 wherein the third actuator of the third bracket assembly comprises a cam and follower assembly, said cam being connected to said control lever and with said follower responding to movements of said cam to control the third loader function as a result of such movements.

8. The control mechanism according to claim 7 wherein said cam includes a slotted plate affixed to said control lever, and with said follower including a roller adapted for movements between opposite ends of said slot and carried by a lever mounted for oscillatory movements on said first bracket assembly.

* * * * *